United States Patent [19]

Bassinger

[11] 4,398,610

[45] Aug. 16, 1983

[54] ROLLER REAMER APPARATUS

[76] Inventor: Grey Bassinger, One Allen Center, Suite 1000, Houston, Tex. 77002

[21] Appl. No.: 250,213

[22] Filed: Apr. 2, 1981

Related U.S. Application Data

[60] Continuation of Ser. No. 156,926, Jun. 6, 1980, abandoned, which is a division of Ser. No. 903,841, May 8, 1978, Pat. No. 4,227,586.

[51] Int. Cl.[3] ..... E21B 10/26

[52] U.S. Cl. ..... 175/228; 175/227; 175/337; 175/371; 175/346; 384/93

[58] Field of Search ..... 175/228, 229, 227, 337, 175/344, 345, 346, 354, 371; 308/8.2, 103, 122

[56] References Cited

U.S. PATENT DOCUMENTS

| | | | |
|---|---|---|---|
| 1,302,058 | 4/1919 | Layne | 175/229 |
| 1,334,632 | 3/1920 | Pickin | 175/354 |
| 2,122,763 | 2/1937 | Smith, Jr. | 175/346 |
| 3,977,481 | 8/1976 | Fisk et al. | 175/228 |
| 4,000,783 | 1/1977 | Hug | 175/346 |

*Primary Examiner*—Ernest R. Purser
*Assistant Examiner*—Thuy M. Bui
*Attorney, Agent, or Firm*—Cox & Smith Incorporated

[57] ABSTRACT

A roller reamer assembly for mounting in a longitudinally extending undercut groove in a reamer body and having longitudinally slidable bearing blocks with cooperating locking members for securing the bearing blocks in the groove upon longitudinal movement of the bearing blocks to prevent undesired longitudinal and radial movement of the bearing blocks and an automatic lubricating system for the bearing blocks.

2 Claims, 6 Drawing Figures

ROLLER REAMER APPARATUS

This is a continuation of prior divisional application Ser. No. 156,926, filed on 6/6/80, now abandoned, which was a Divisional application of application Serial No. 903,841, filed on 5/8/78 and now U.S. Pat. No. 4,227,586, dated 10/14/80.

BACKGROUND OF THE INVENTION

This invention relates generally to a borehole contacting apparatus for mounting on a bottom hole assembly of a drill string. More specifically, the invention is directed to a roller reamer apparatus which has a self-tightening mounting system with self-lubricating bearings and which is easily replaced with minimum down time during drilling operations.

It is well known in the art that roller cutters may be used as reamers on the bottom of a drill string for enlarging the borehole. Known U.S. Patents disclosing roller reamers are as follows: U.S. Patent Nos. 2,122,763; 2,172,762; 2,189,033; 2,189,035; 2,189,036; 2,189,037; 2,199,693; 2,218,743; 2,260,366; 2,306,492; 2,695,771; 2,716,020; 3,303,900; 3,306,381; 3,627,068; and 3,907,048. As shown by the above listed patents, numerous attempts have been made to obtain a rigid secure fit of a roller reamer with a reamer body, while at the same time allowing ease of removal and replacement of the shafts or spindles and roller.

In particular, U.S. Pat. No. 2,122,763 issued to Smith discloses a mounting system and the present invention includes a self-tightening locking system which is an improvement thereof. Smith discloses locking means, consisting of bolts 19 which connect wedge plates 12 that have been driven into engagement with bearing blocks 7. The wedge plate 12 comprises three angled surfaces to enable it to be inserted radially with minimum axial movement. The rib 13 on bearing block 7 prevents axial movement of the block in the mounting slot thereby preventing any self-tightening of the locking means induced by the thrust of the cutters and frictional engagement of the locking means with the borehole.

An attempt to provide a structure which uses no bolts or threaded parts in mounting the roller reamer to the reamer body is shown in U.S. Pat. No. 2,189,036 issued to Jones, U.S. Pat. No. 2,306,492 issued to W. B. Noble, and U.S. Pat. No. 3,189,037 issued to Harrington. A device in common use today, which is manufactured by the Drilco Division of Smith International, Inc., utilizes a cross pin to retain a bearing block which supports a reamer pin. The Drilco device does not utilize a wedge, such as the wedge 11 shown by Noble or the wedge 18 shown in Harrington, and the cross pin it uses is a spring pin which is driven into an upper bearing block to retain the main reamer pin and reamer cutter. A similar design is shown in U.S. Pat. No. 3,303,900. The reamer pin in the Drilco device does not rotate, but rather is locked into position so that the reamer cutter rotates relative to the supporting reamer pin. Cap screws have been used as a secondary locking device for locking the reamer pins from rotation relative to the bearing blocks.

Certain problems may arise with the use of a locking cross pin. For instance, if the pin becomes broken for any reason, forces on the bearing blocks may tend to cause them to loosen. Also, locking cross pins such as shown in the Drilco device require accurate alignment of the bearing block aperture which receives the locking cross pin with grooves in the reamer body. Similar problems occur if the spring ring of Harrington breaks or becomes dislodged.

Other known patents are U.S. Pat. Nos.: 3,818,999; 3,370,657; 2,973,996; 2,288,124; 1,062,841; 3,856,096; 3,680,647; 3,938,853; 3,445,144; 3,799,279; 2,084,421; 1,810,030; and 2,864,586.

So far as known, a problem has existed with wearing between the bearing surfaces which include the interior cylindrical surface of the reamer cutter and the outer cylindrical surface of the reamer pin. Lubrication systems are disclosed in U.S. Pat. No. 3,907,048 issued to Gray and U.S. Pat. No. 3,303,900 issued to Kloesel, et al. In practice the bearing surfaces may be worn out long before the cutting surfaces of the reamer cutter since it has been a common practice to use tungsten carbide inserts to reduce wear of the roller cutter. It has also been a practice to rotate the stationary reamer pin 180° in the bearing block since the pressure of the reamer cutter against the well bore tends to cause excess wear on the outer facing surface of the reamer pin. The same wearing problems would be present if the reamer pin rotated in the bearing blocks and the reamer cutter was affixed to the reamer pin. It is therefore apparent that the most important aspect of mounting reamer cutters in a reamer body is that they be mounted as firmly as possible to prevent any possibility of play between the parts constituting the mounting during the operation of the reamer.

It is thus desirable to provide a securing means for a reamer pin bearing block which will securely retain the bearing block within a slot in the reamer body and which can be easily removed for replacement of the reamer cutter. It is important to provide secure locking of the retaining means for the bearing blocks so that pulling into and out of the well bore will not loosen the bearing blocks, while at the same time allowing replacement of worn parts without difficulties. It is also important to protect the bearing surfaces which provide the rotation of the reamer cutter so that the bearing surfaces will permit longer use of the cutting surfaces on the reamer cutter.

As shown by the above patents, several attempts have been made over many years to provide a suitable mounting means and also to protect the bearings. Despite the many attempts, it is believed that the present invention overcomes many of the problems for which a solution has been sought for many years. The reamer assembly is safely and securely mounted, yet it can be simply replaced. The life of the bearing surfaces is increased which increases drilling efficiency.

SUMMARY OF THE INVENTION

The invention relates to a new and improved borehole wall reamer having a secure self-tightening bearing block mount and a protective lubricating means for the bearing surfaces.

The borehole reamer comprises a cylindrical reamer cutter having conventional hardened inserts and a borehole engaging surface thereof for engaging the borehole of a well. A male bearing journal is formed integrally with the reamer cutter at opposite ends thereof. The bearing journal portions of the reamer cutter are rotatably mounted in mating female bearing journals in a bearing block, which is retained within an undercut groove of the reamer body with first, second and third coacting locking members which are locked in place through relative longitudinal movement between the locking members. A longitudinal bore is provided throughout the length of the reamer cutter and extends through the male journals at opposite ends thereof. A transverse passage way extends through the bearing block for communicating drilling fluids to the longitudinal passage way. A plurality of sealing piston means are provided for applying pressure to a lubricating medium which is packed within the longitudinal bore. The fluid pressure in the well is communicated through the transverse passage way to the sealing piston means to force lubrication to the bearing surfaces. Fluid in the well, which fluid may contain abrasive materials, is substantially prevented from coming in contact with the bearing surfaces by a seal means which has substantially balanced pressures on each side of the seal.

DETAILED DESCRIPTION OF THE PREFERRED EMBODIMENT

Figure 1:
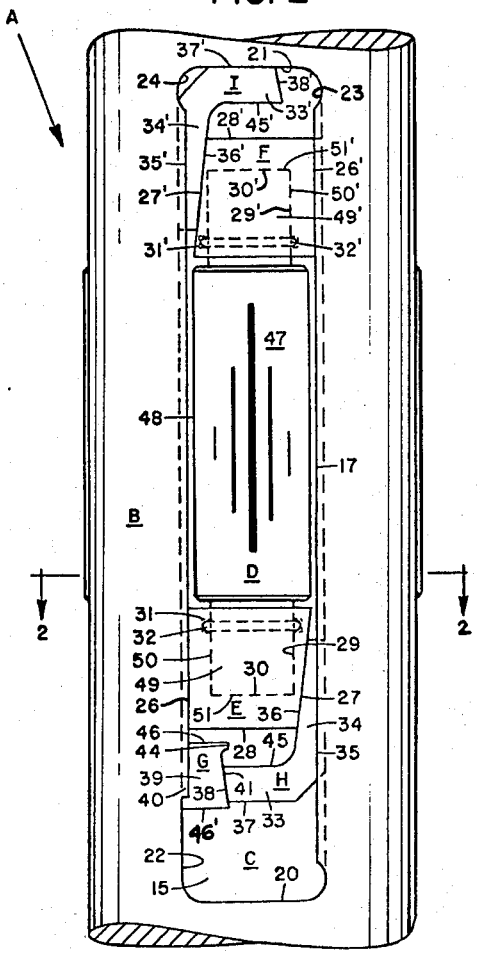
FIG. 1 is a side elevation showing one embodiment of the borehole reamer assembly.
Figure 4:
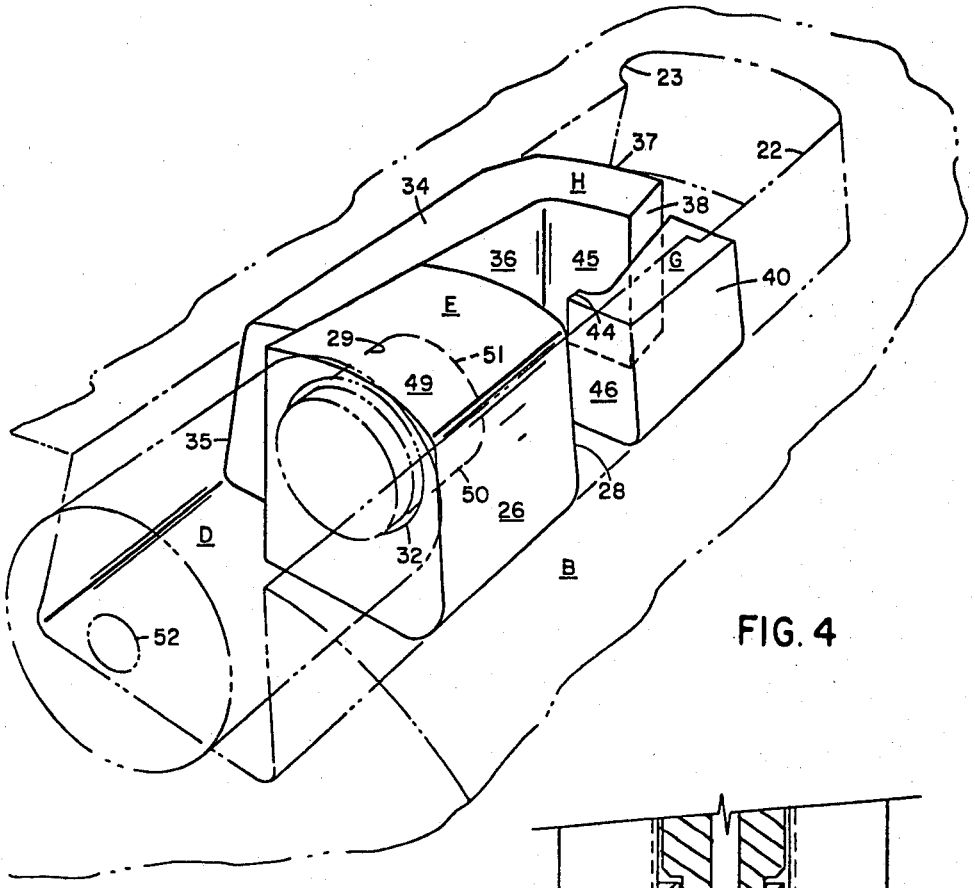
FIG. 4 is a broken perspective view showing the components of the bearing block and locking means of FIG. 1 of the reamer body.

Referring to FIG. 1 of the drawings, there is shown a segment of a borehole reamer assembly in accordance with the invention. Each borehole reamer apparatus A includes a reamer body portion B which is generally cylindrical and which includes a plurality of circumferentially spaced undercut grooves C. The grooves may have any of several cross sectional configurations, however, a dovetail is preferred. A rolling reamer cutter assembly D is mounted for rotation in bearing blocks E and F. The bearing blocks E and F are retained within the dovetail groove C by first, second and third locking members I, H and G.

Figure 2:
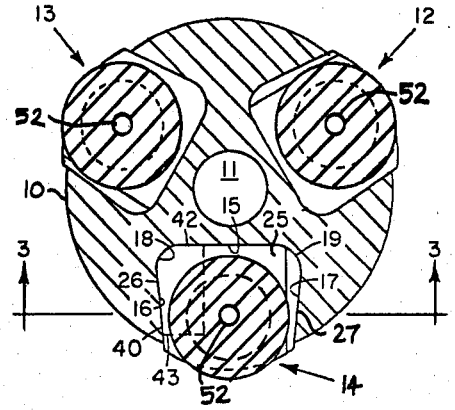
FIG. 2 is a cross sectional view taken along line 2—2 of FIG. 1.
Figure 3:
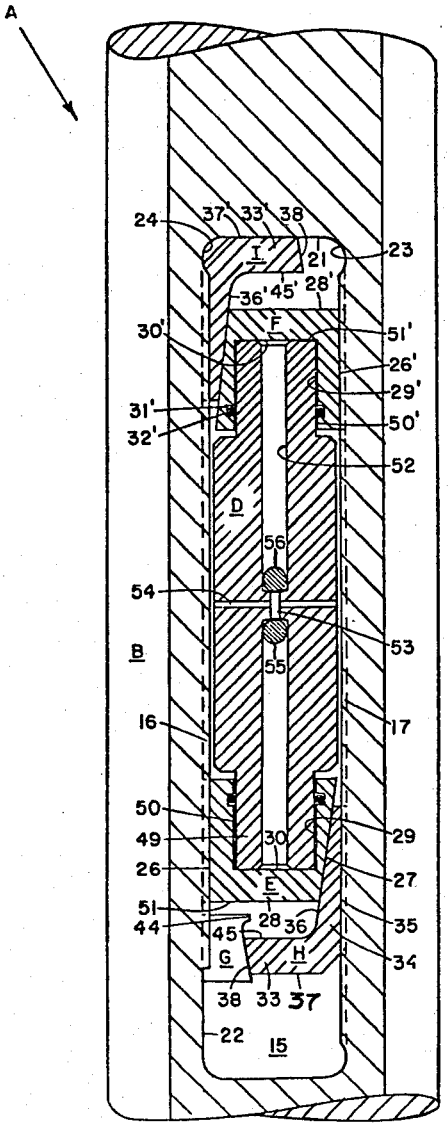
FIG. 3 is a cross sectional view taken along line 3—3 of FIG. 2.

As shown in FIG. 2, the reamer body portion B includes an outer cylindrical surface 10 and a longitudinally extending bore 11 for drilling fluid. A plurality of borehole reamer apparatus 12, 13 and 14 are equally spaced from each other about the outer cylindrical surface 10. Each dovetail groove and reamer assembly is identical, so a detailed description is provided for only the borehole reamer apparatus 12. The dovetail groove in which the borehole reamer apparatus 12 is mounted includes a rear wall 15 and outwardly converging side walls 16 and 17. The side walls 16 and 17 merge with the rear wall 15 through curved portions 18 and 19, respectively. The side walls 16 and 17 coact to retain the bearing blocks E and F within the dovetail groove C, as explained more fully hereinafter. The groove further includes a lower wall 20 and an upper wall 21. As shown in FIG. 1, a portion of the side wall 16 is removed to provide a side wall portion 22 which is generally perpendicular to the rear wall 15 for purposes explained more fully hereinafter. The upper wall 21 includes notched out portions 23 and 24.

The bearing block E includes a rear wall 25 which engages the rear wall 15 of the dovetail groove. The side wall 26 of the bearing block engages the side wall 16 of the dovetail groove. The angle between the rear wall 25 and side wall 26 is the same as the angle between the rear wall 15 and side wall 16 of the groove, so that a mating fit is provided. The bearing block E further includes a side wall 27 which is inclined relative to the longitudinal axis of the reamer body portion. Bearing block E further includes a lower wall 28. A cylindrical aperture is provided in the bearing block as defined by the cylindrical side wall 29 and end wall 30. A cylindrical groove 31 is provided in the cylindrical side wall 29 for receiving a conventional O-ring type seal 32. As will be apparent, the cylindrical opening in the bearing block receives the reamer pin portion which is secured with the roller reamer cutter D for relative rotation therebetween. The bearing block F has a side wall 26' and another side wall 27' and an upper wall 28'. The bearing block further includes a centrally positioned bearing aperture defined by cylindrical side wall 29' and end wall 30'. A cylindrical groove 31' is provided in the cylindrical side wall 29' for receiving an O-ring type seal 32'. As will be apparent, the bearing block F rotatably mounts the other reamer pin portion of the roller reamer cutter D. The bearing blocks E and F are identical.

A first locking member I comprises a generally L-shaped member having a base portion 33' and a leg portion 34'. The leg portion 34' includes an inclined side wall 35' which engages the side wall 16 of the groove and another side wall 36' which engages the side wall 27' of the bearing block F. The side walls 36' and 27' are perpendicular to the rear wall 15 of the body B. Accordingly, the bearing block and first locking means cannot be removed or inserted radially. Any radial movement will tend to increase the forces between the walls 27' and 36' to retain the bearing block and first locking means within the dovetail groove. This eliminates the need for any additional locking means to prevent undesired radial movement. As will be apparent, longitudinal movement of the side walls 27' and 36' relative to each other will wedge the bearing block surface 26' into engagement with the groove side wall 17 and the side wall 35' against the groove side wall 16. The base portion 33' includes a top wall 37' which engages groove wall 21. The base portion 33' further includes an inclined wall 38'.

The second locking member H is identical in construction to the first locking member I and accordingly, the same reference numerals are used with the deletion of the prime (') symbol on the reference numerals for the second locking member. As will be apparent, longitudinal movement of the bearing block E and the second locking member H relative to each other to the camming surfaces 27 and 36 force the side wall 35 into engagement with the dovetail grooved side wall 17 and will force the bearing block side wall 26 into engagement with the dovetail side wall 16 to rigidly lock the bearing block in place. The locking between the second locking member H and bearing block E is identical to the locking of the first locking member I and the bearing block F. Radial loosening of the locking member H and bearing block E is also prevented as discussed above by the same relationship between mating wall surfaces 27 and 36 and wall 15.

A third locking member G is provided which functions as a traveling key lock to rigidly secure the second locking member against any longitudinal movement in the dovetail slot to prevent any undesired loosening of the bearing block E. The third locking member G includes a key lock body 39 which has a side wall 40 which mates with the side wall 16 as best shown in FIG. 2 and an inclined side wall 41 which mates with the inclined side wall 38 on a second locking member. The rear wall 42 of the key lock body 49 engages the rear wall 15 and the front wall 43 is recessed from the outer cylindrical wall 11. The inclined side wall 41 inclines to a lip extension 44 which is adapted to engage the wall 45 of the base portion 33 of the second locking member H. Relative longitudinal movement of the lip extension 44 away from the wall 45 on the second locking member will tend to force the second locking member side wall 35 into engagement with the grooved side wall 17 and the third locking member side wall 40 into engagement with the dovetail grooved side wall 16.

In operation, the first locking member I is inserted into the groove and moved upwardly until the top wall 37' engages the wall 21. Bearing block F is then inserted in the groove andslid upwardly until its inclined side wall 27' engages the inclined side wall 36' of the leg portion of the first locking member. Relative longitudinal movement of the bearing block F relative to the first locking member I will tightly wedge and retain the bearing block F in position within the dovetail groove. With the roller reamer cutter D in position as shown in FIGS. 1 and 2, the side wall 26 of the bearing block E can engage the dovetail grooved side wall 16. The second locking member H is then inserted in the groove and driven upwardly so as to tightly lock the bearing block E in position in the dovetail groove. However, prior to forcing the leg portion 34 of the second locking member upwardly, the third locking member G is inserted in position with the inclined wall 38 of the second locking member positioned across from the side wall 22 so that the third locking member G may be inserted in the groove with the inclined wall 38 of the base of the second locking member moved toward the lip extension 44. The first and second locking members may then be moved upwardly within the dovetail groove whereby the side wall 40 of the third locking member will engage the dovetail groove side wall 16. Then, an upward blow is applied to the wall 37 of the second locking member and another upward blow may be applied to the wall 46 of the third locking member to tightly wedge the third locking member with the second locking member.

If by chance the third locking member should become loose, it cannot slice out of position because the lip extension 44 will engage the lower wall 45 of the base portion 33 so that the first locking member can only be removed upon longitudinal movement of the second locking member to release it so that the side wall 40' of the third locking member will be out of engagement with the dovetail groove side wall 16. The third locking member cannot move radially because of the perpendicular relationship of the wall surfaces 38 and 41 and rear wall 15.

The mating surfaces of the second and third locking members make it virtually impossible for the second locking member to be loosened from the bearing block E so that the bearing block E is rigidly held in place inside the dovetail groove, which in turn rigidly holds the bearing block F in place inside the dovetail groove through the first locking member I. In order to remove the borehole reamer apparatus A, it is only necessary to apply a striking force to the wall 46 of the third locking member to force it downwardly until the lip extension 44 approaches the wall 45 of the second locking member, which allows the second locking member to be forced downwardly along with the first locking member to release the bearing block E. The bearing block F may then be forced downwardly to remove it from the first locking member I. Each of the engaging surfaces between the first locking member I, bearing block F and the second locking member H and bearing block E and the second locking member H and third locking member G require longitudinal movement in opposite directions in order to release the locking surfaces. Also, the engaging surfaces are restrained from radial movement by the perpendicular relationship between the locking means engaging walls and rear wall of the dovetail groove.

The roller reamer cutter D includes a cylindrical body portion 47 which includes a cylindrical outer cutting surface 48. Tungsten carbide inserts are generally provided in the cylindrical outer cutting surface 48 to increase its life. Cylindrical body portion 47 includes male bearing journals 49 and 49' at the end thereof, which are received in the female bearing journals in the bearing blocks E and F, respectively, whereby the outer cylindrical bearing surfaces 50 and 51' rotatably engage the cylindrical walls 29 and 20'. The end surfaces 50' and 51' of the male journals 49 and 49' rotatably engage the end walls 30 and 30' of the bearing blocks.

The roller reamer cutter D further includes a longitudinally extending bore 52 having a reduced mid-section extending throughout its length. A transverse passageway 54 extends all the way through the cylindrical body portion 47 of the roller reamer cutter D for communicating drilling fluids therethrough. Piston seal means 55 and 56 which preferably are spherical balls are slidably mounted within bore 52 on each side of the reduced mid-section 53, so that pressurized fluid entering transverse passageway 54 will tend to push the piston means 55 and 56 away from each other. When the borehole reamer assembly A is mounted within the reamer body B, a lubricating fluid such as grease is packed in the bore 52, so that the piston means 55 and 56 will force the grease around the bearing surfaces of the bearing blocks E and F. The pressure on each side of the O-rings 32 and 32'is substantially the same to prevent any well fluid or abrasives from getting into the bearing surfaces which could cause severe damage and ruin the bearing surfaces.

Figure 5:
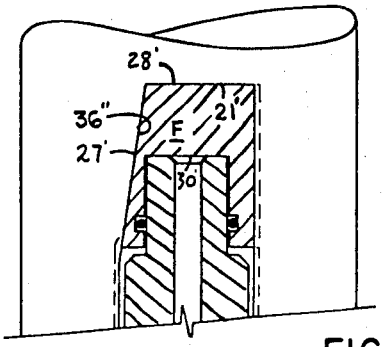
FIG. 5 is a fragmentary sectional view of another embodiment of the first locking means of the reamer assembly.

FIG. 5 depicts a modification of the first locking means with like parts having like numeral designations as utilized in FIG. 1–4. In this modification, the first locking member I has been made integral with the groove and comprises a tapered groove wall surface 36'' which terminates at its upper end with the upper groove end wall 21'. The tapered wall surface 36'' corresponds exactly with the sidewall 36' of the first locking member I and engages the sidewall 27' of the bearing block F in an identical manner.

Figure 6:
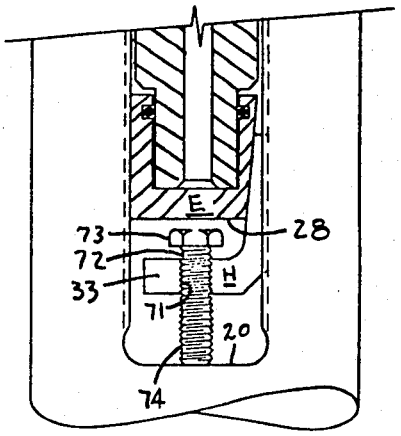
FIG. 6 is a fragmentary sectional view of another embodiment of the second and third locking means of the reamer assembly.

Referring now to FIG. 6, the second locking means H has a tapped hole 71 through the base portion 33 with a bolt 72 mounted therein with the bolt head 73 positioned in the space between the base portion 33 of the second locking means and the upper wall 28 of bearing block E. The shank portion 74 of the bolt 72 is extendable into engagement with the lower wall 20 of the groove. The bolt 72 replaces the traveling key lock which comprises the third locking member G depicted in FIGS. 1–4 and functions in like manner to rigidly secure the second locking member against downward longitudinal movement in the dovetail groove. In operation, as the bolt 72 is turned clockwise in the tapped hole 71, the shaft 74 comes into reactive engagement with the wall to force the second locking means upward into tight locking engagement with the bearing block E. To unlock the device, the bolt is turned counter-clockwise until the bolt head 73 comes into reactive engagement with the wall 28 of the bearing block to force the locking member H out of locking engagement with bearing block E.

One of the most significant problems with roller reamers has been preventing excess wear on the bearing surfaces before the cutting surfaces of the roller reamer cutter are worn. The self-tightening mounting means and the pressurized lubrication system, as discussed above, tends to greatly lengthen the life of the bearing surfaces so that the roller reamer may be used for longer periods of time without removal of the drill string from the borehole for rotation of the bearing blocks or entire replacement of the cutter and reamer pins.

While there has been shown and described a preferred embodiment of a reamer apparatus in accordance with the invention, it will be appreciated that many changes and modifications may be made therein without, however, departing from the essential spirit of the invention within the scope of the claims. One obvious modification would be to eliminate the mid portion of the undercut groove as is common practice in the prior art. Another obvious modification would be to incorporate the lubricating fluid system in the bearing blocks rather than in the roller cutter.

I claim:

1. A self lubricating roller reamer assembly mounted on a reamer body comprising a roller cutter having a bearing journal integral therewith on each end thereof;

a bearing block mounted on said reamer body at either end of said roller cutter, each of said bearing blocks having a bearing journal matingly receiving a roller cutter having a bearing journal integral therewith on each end thereof;

sealing means mounted in said bearing journals to seal against drilling fluids;

a lubricating fluid passageway in said roller reamer assembly communicating with said bearing journals behind said seal rings to deliver lubricating fluid to the bearing journals;

said fluid passageway including a longitudinal bore through said roller cutter, said longitudinal bore being packed with lubricating fluid and having a reduced cross section intermediate the ends thereof with a sliding pistion seal mounted in said bore on either side of the reduced section and a fluid passageway communicating drilling fluid from the well bore to the reduced cross section of the longitudinal bore to apply pressure to the piston seal and thereby force lubricating fluid to the bearing journals.

2. A self-lubricating roller reamer assembly mounted on a reamer body comprising a roller cutter having a bearing journal integral therewith on each end thereof;

a bearing block mounted on said reamer body at either end of said roller cutter, each of said bearing blocks having a bearing journal matingly receiving a roller cutter having a bearing journal integral therewith on each end;

sealing means mounted in said bearing journals to seal against drilling fluids;

a lubricating fluid passageway in said roller reamer assembly containing lubricating fluid and communicating with said bearing journals behind said seal rings to deliver lubricating fluid to the bearing journals;

said fluid passageway including a longitudinal bore through said roller cutter, said longitudinal bore being packed with lubricating fluid and having a sliding piston seal means mounted in said bore to supply lubricating fluid to the bearing journals.

* * * * *